US006219016B1

(12) United States Patent
Lee

(10) Patent No.: US 6,219,016 B1
(45) Date of Patent: Apr. 17, 2001

(54) LIQUID CRYSTAL DISPLAY SUPPLY VOLTAGE CONTROL CIRCUITS AND METHODS

(75) Inventor: Hyong-Gon Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/149,974

(22) Filed: Sep. 9, 1998

(30) Foreign Application Priority Data

Sep. 9, 1997 (KR) ..... 97-46287

(51) Int. Cl.[7] ..... G09G 3/36

(52) U.S. Cl. ..... 345/87; 345/92; 345/211; 345/214; 345/94; 345/98; 345/212; 345/89

(58) Field of Search ..... 345/92, 212, 213, 345/214, 100, 98, 87, 206, 211, 89, 94

(56) References Cited

U.S. PATENT DOCUMENTS 4,716,341 * 12/1987 Oida et al. ..... 345/212

5,945,970 * 8/1999 Moon et al. ..... 345/92

* cited by examiner

*Primary Examiner*—Richard Hjerpe
*Assistant Examiner*—Ali Zamani
(74) *Attorney, Agent, or Firm*—Myers Bigel Sibley & Sajovec

(57) ABSTRACT

Liquid crystal displays include power supply control circuits and methods that are responsive to a single DC input supply voltage, to generate operating voltages for the gate driver, the data driver and the timing converter of the liquid crystal display from the single DC input supply voltage. Preferably, the data driver supply voltage and the gate driver supply voltage are generated prior to generating the gray scale voltage and the gate ON and OFF voltages. Also preferably, the timing converter supply voltage is generated prior to generating the gray voltage and the gate ON and OFF voltages. Accordingly, a single external power supply voltage may be used to generate the requisite supply and operational voltages for the components of the liquid crystal display. Moreover, the sequence of energizing the various components of the liquid crystal display may be automatically controlled, so that improper operation and/or failure of the liquid crystal display can be reduced and preferably prevented.

12 Claims, 2 Drawing Sheets

LIQUID CRYSTAL DISPLAY SUPPLY VOLTAGE CONTROL CIRCUITS AND METHODS

FIELD OF THE INVENTION

This invention relates to display devices, and more particularly to liquid crystal display devices.

BACKGROUND OF THE INVENTION

Liquid crystal displays are widely used flat panel display devices. As is well known to those having skill in the art, a liquid crystal display includes a liquid crystal display panel that displays images using the variable transmissivity of liquid crystals in response to applied voltages. The liquid crystal display panel includes gate lines, data lines and an array of thin film transistors that are connected to the gate lines and the data lines. A data driver drives the data lines with a gray voltage, also referred to as a gray scale voltage, and is powered by a data driver supply voltage. A gate driver drives the gate lines with gate ON and OFF voltages, and is powered by a gate driver supply voltage. A timing converter is connected to the gate driver and the data driver to control timing of the gate driver and the data driver, and is powered by a timing converter supply voltage. The data driver, gate driver and timing converter may use different supply voltage levels. For example, the data driver supply voltage, gate driver supply voltage and timing converter supply voltage may be 3.3 volts or 5 volts. The gate ON voltage may be between 15 and 40 volts, and the gate OFF voltage may be between 0 and −15 volts. The gray voltage may be 5 volts or 10.5 volts.

The above-described voltages may be generated by a DC-to-DC converter that is part of the liquid crystal display. The DC-to-DC converter may receive supply voltages of 5 volts and 12 volts, and can convert these voltages to the various voltage levels described above.

In generating these voltages, it may be important that the various voltage levels are applied to the components of the liquid crystal display in a proper sequence, so that the liquid crystal display does not malfunction or become damaged. For example, if the gate ON or gate OFF voltage is generated before the timing converter supply voltage and the gate driver supply voltage, the gate ON and OFF voltage may be applied to the thin film transistors in the liquid crystal display panel before the timing converter and/or the gate drivers become operational. As a result, it is possible for the gate ON voltage or the gate OFF voltage to simultaneously turn on all of the thin film transistors. This may cause an excess amount of current to flow to the liquid crystal display panel and can result in a malfunction of the liquid crystal display panel and/or damage to the gate driver.

In order to reduce the likelihood that these problems may arise, the timing sequences in which the various voltages are applied to the various components of the LCD may be adjusted using an external device. The sequence of applying supply voltages to the various components may be set during manufacturing. Unfortunately, this may complicate the manufacturing process and may still result in improper operation of the liquid crystal display after manufacturing, which may damage the liquid crystal display.

SUMMARY OF THE INVENTION

It is therefore an object of the present invention to provide improved supply voltage control circuits and methods for liquid crystal displays.

It is another object of the present invention to provide supply voltage control circuits and methods that can reduce the likelihood of improper voltages being applied to the various components of a liquid crystal display.

It is another object of the invention to provide liquid crystal display supply voltage control circuits and methods that need not be individually set during manufacturing.

These and other objects are provided, according to the present invention, by liquid crystal displays that include power supply control circuits and methods that are responsive to a single DC input supply voltage, to generate operating voltages for the gate driver, the data driver and the timing converter of the liquid crystal display from the single DC input supply voltage. Preferably, the data driver supply voltage and the gate driver supply voltage are generated prior to generating the gray scale voltage and the gate ON and OFF voltages. Also preferably, the timing converter supply voltage is generated prior to generating the gray voltage and the gate ON and OFF voltages.

Accordingly, a single external power supply voltage may be used to generate the requisite supply and operational voltages for the components of the liquid crystal display. Moreover, the sequence of energizing the various components of the liquid crystal display may be automatically controlled, so that improper operation and/or failure of the liquid crystal display can be reduced and preferably prevented.

More specifically, liquid crystal displays according to the present invention include a liquid crystal display panel that displays images. The liquid crystal display panel includes a plurality of gate lines and data lines. A gate driver drives the gate lines and a data driver drives the data lines. A timing converter is connected to the gate driver and the data driver to control timing of the gate driver and the data driver. A power supply control circuit is responsive to a single DC input supply voltage, to generate operating voltages for the gate driver, the data driver and the timing converter from the single DC input supply voltage.

The data driver preferably drives the data lines with a gray voltage and is powered by a data driver supply voltage. The power supply control circuit generates the gray voltage and the data driver supply voltage from the single DC input supply voltage. Also preferably, the gate driver drives the gate lines with gate ON and OFF voltages and is powered by a gate driver supply voltage. The power supply control circuit generates the gate ON and OFF voltages and the gate driver supply voltage from the single DC input supply voltage.

According to another aspect of the invention, power supply control circuits and methods generate the data driver supply voltage and the gate driver supply voltage prior to generating the gray voltage and the gate ON and OFF voltages. The power supply control circuits and methods also preferably generate the timing converter supply voltage prior to generating the gray voltage and the gate ON and OFF voltages.

In a preferred embodiment, power supply control circuits preferably include a first DC-to-DC converter that is responsive to the single DC input supply voltage to generate at least one supply voltage that is supplied to the gate driver, the data driver and the timing generator. The power supply control circuits also include a gray voltage generator that is responsive to a gray voltage generator supply voltage, to generate gray voltages for the data driver. A second DC-to-DC converter is responsive to the first DC-to-DC converter, to generate the gray voltage generator supply voltage. A gate voltage generator is responsive to the gray voltage generator supply voltage, to generate gate ON and OFF voltages for the gate driver from the single DC input supply voltage.

The power supply control circuits also preferably include a switch that is connected between the single DC input supply voltage, the gate voltage generator and the gray voltage generator supply voltage, to supply the single DC input supply voltage to the gate voltage generator in response to the gray voltage generator supply voltage. The switch is preferably a transistor having a controlling electrode and a pair of controlled electrodes. The pair of controlled electrodes are connected between the single DC input supply voltage and the gate voltage generator, and the controlled electrode is preferably connected to the gray voltage generator supply voltage.

In another embodiment, the first DC-to-DC converter is responsive to the single DC input supply voltage, to generate first and second digital circuit supply voltages that are applied to digital circuits of the liquid crystal display. The second DC-to-DC converter is responsive to the second supply voltage. Accordingly, multiple internal operating voltages for liquid crystal displays may be generated from a single external DC supply voltage and may be sequenced to avoid malfunction and/or damage to the liquid crystal display. Individual adjustment during manufacturing need not be performed.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
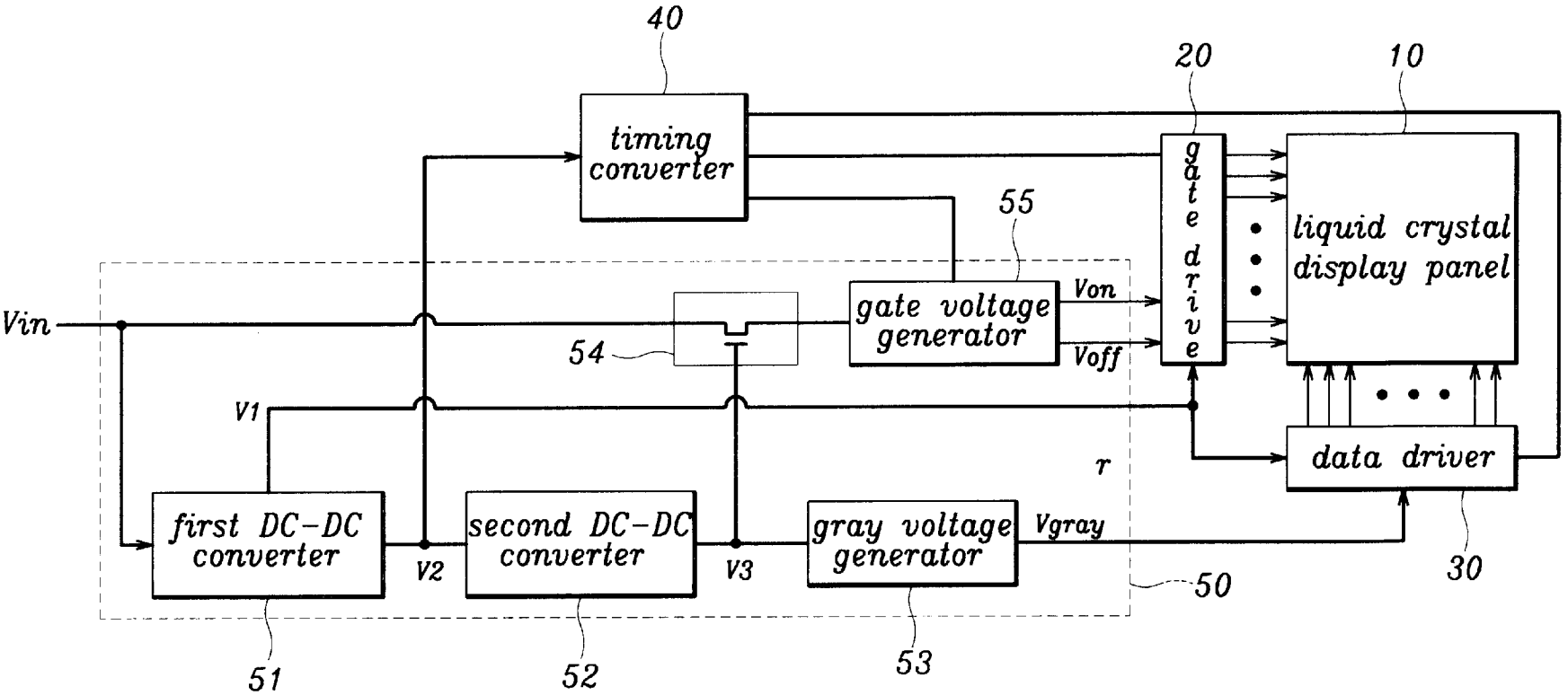
FIG. 1 is a block diagram of liquid crystal display systems and methods according to the present invention.

Referring now to FIG. 1, a block diagram of liquid crystal displays and methods according to the present invention is shown. In FIG. 1, signal flows are represented by thin lines, while supply voltage flows are represented by thick lines. As shown in FIG. 1, a liquid crystal display includes a liquid crystal display panel 10 that displays images. As is well known to those having skill in the art, the liquid crystal display panel 10 includes a plurality of gate lines and data lines and an array of thin film transistors that are connected to the gate lines and data lines. A gate driver 20 drives the gate lines. A data driver 30 drives the data lines. A timing converter 40 is coupled to the gate driver 20 and to the data driver 30 to control timing of the gate driver and the data driver. The design and operation of liquid crystal display panel 10, gate driver 20, data driver 30 and timing converter 40 are well known to those having skill in the art, and need not be described further herein.

Still referring to FIG. 1, a power supply control circuit 50 generates various supply voltages and operational voltages for the components of the liquid crystal display from a single external DC input supply voltage Vin. More specifically, the power supply control circuit 50 generates a gate driver supply voltage and a data driver supply voltage V1, a timing converter supply voltage V2, a gray voltage Vgray and gate ON and OFF voltages Von and Voff from the single external DC input supply voltage Vin.

A detailed description of the power supply control circuit 50 will now be provided. As shown in FIG. 1, the power supply control circuit 50 includes a first DC-to-DC converter 51 that is responsive to the single DC input supply voltage Vin, to generate digital circuit power supply voltages V1 and V2 that are applied to digital circuits of the liquid crystal display. In particular, the first DC-to-DC converter 51 receives the external DC input supply voltage Vin, to generate both a first supply voltage V1 to power the gate driver 20 and the data driver 30, and a second supply voltage V2 to power the timing converter 40. The DC input supply voltage Vin may be a 12 volt source and the first DC-to-DC converter 51 may use the DC input supply voltage to generate the first supply voltage V1 of 3.3 volts and the second supply voltage V2 of 5 volts. It will also be understood that the voltage levels of the first and second supply voltages V1 and V2 may be the same, depending upon the requirements of the digital circuits to which the voltages are supplied.

Still continuing with the description of the power supply control circuit 50, a second DC-to-DC converter 52 is responsive to the first DC-to-DC converter 51, to generate a third supply voltage V3. The third supply voltage V3 may be 10.5 volts. As shown in FIG. 1, the third supply voltage is applied to the gray voltage generator 53, to provide a gray voltage generator supply voltage. The third supply voltage V3 is also applied to a switch 54 as will be described in detail below.

The gray voltage generator 53 receives the third supply voltage V3 from the second DC-to-DC converter 52, to generate the gray voltage Vgray. As will be understood, the gray voltage Vgray generally has a plurality of gray scale voltage levels that are used to display varying shades of gray or color on the liquid crystal display panel 10. The gray voltage Vgray is applied to the data driver 30 which applies the gray voltage Vgray to appropriate thin film transistors of the liquid crystal display panel 10.

Still referring to FIG. 1, the gate voltage generator 55 is responsive to the gray voltage generator (third) supply voltage V3, to generate gate ON and OFF voltages Von and Voff for the gate driver 20 from the single DC input supply voltage Vin. More specifically, a switch 54 is connected between the single DC input supply voltage Vin, the gate voltage generator 55 and the gray voltage generator supply voltage V3, to supply the single DC input supply voltage Vin to the gate voltage generator 55 in response to the gray voltage generator supply voltage V3. The switch 54 is preferably a transistor such as a field effect transistor illustrated in FIG. 1. The transistor has a controlling electrode (for example a gate) and a pair of controlled electrodes (for example source and drain electrodes). The pair of controlled electrodes are connected between the single DC input supply voltage Vin and the gate voltage generator 55. The controlled electrode is connected to the gray voltage generator supply voltage V3.

Thus, the switch 54 controls the application of the DC input supply voltage Vin to the gate voltage generator 55 using the third supply voltage V3 that is provided by the second DC-to-DC converter 52. Specifically, the input supply voltage Vin is applied to the gate voltage generator 55 only if the third supply voltage V3 is being applied to the switch 54.

The gate voltage generator 55 receives the DC input supply voltage Vin, generates the gate ON voltage Von and the gate OFF voltage Voff, and applies these voltages to the gate driver 20. The gate ON voltage Von may be generated at a level of 30 volts, while the gate OFF voltage Voff may be generated at a level of −15 volts. The gate voltage generator 55 may use a charge pump circuit, and the DC input supply voltage Vin may be used as an input to the charge pump circuit, so that the efficiency of increasing the voltage may be increased.

Figure 2:
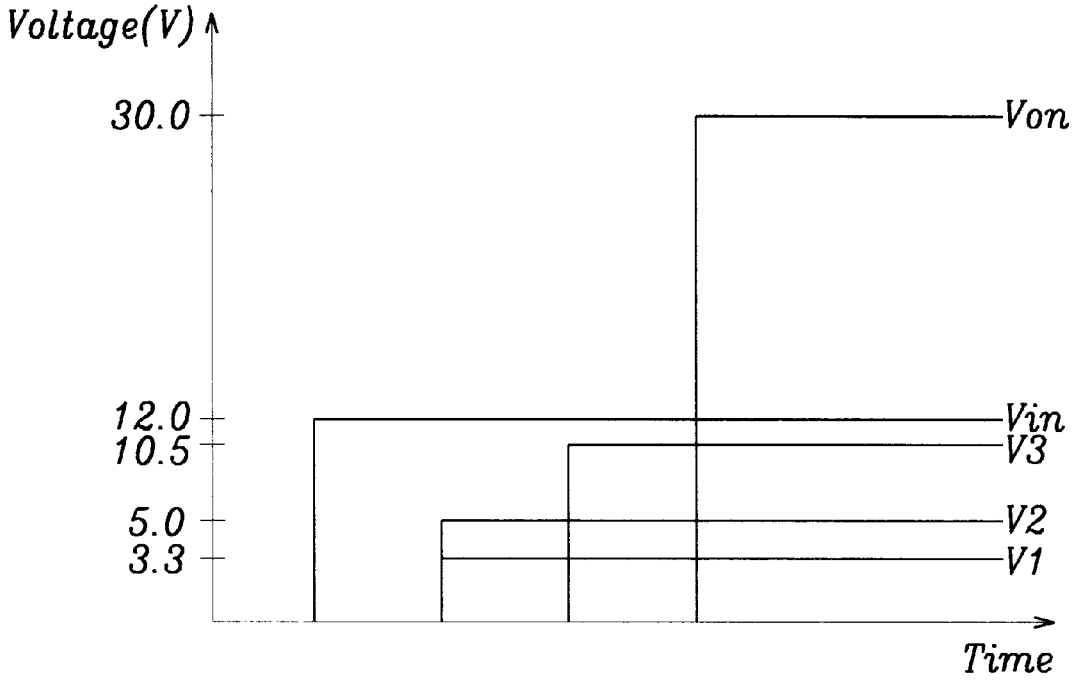
FIG. 2 graphically illustrates a power supply sequence for liquid crystal displays according to the present invention.

Referring now to FIG. 2, a sequence of applying the above-described voltages to the liquid crystal display is graphically illustrated. As shown in FIG. 2, the DC input supply voltage Vin is applied first, followed by either the simultaneous or sequential application of the first and second supply voltages V1 and V2. The third supply voltage V3 is supplied next. Then, the gate OFF and gate ON voltages Voff and Von are either simultaneously or sequentially applied. For ease of illustration, the gate OFF voltage is not shown in FIG. 2.

Thus, both the gate ON voltage Von and the gate OFF voltage Voff are generated only if third supply voltage V3 is applied to the switch 54. Moreover, the second supply voltage V2 must be applied to the second DC-to-DC converter 52 in order for the second DC-to-DC converter 52 to generate the third supply voltage. Thus, the gate OFF voltage Voff and the gate ON voltage Von are only generated after the second supply voltage V2 is supplied to the timing converter 40 so that the timing converter is operational.

Therefore, since the gate ON voltage Von is generated and applied to the gate driver 10 only after the timing converter 40 begins to operate, the application of overcurrent to the liquid crystal display panel 10 may be reduced and preferably prevented. Moreover, the LCD can operate by receiving a single external supply voltage so that the design of the system that uses the LCD panel may be simplified.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A liquid crystal display power supply that generates digital circuit power supply voltages, gray voltages and gate ON and OFF voltages for a liquid crystal display, the power supply comprising:

at least one DC-to-DC converter that is responsive to a single DC input power supply voltage to generate at least one digital circuit power supply voltage that supplies power to digital circuits of the liquid crystal display and to generate a gray voltage generator power supply voltage;

a gray voltage generator that is powered by the gray voltage generator power supply voltage to generate gray voltages for the liquid crystal display;

a gate voltage generator that is responsive to the gray voltage generator power supply voltage, to generate gate ON and OFF voltages for the liquid crystal display from the single DC input power supply voltage; and a switch that is connected between the single DC input power supply voltage, the gate voltage generator and the gray voltage generator power supply voltage, to supply the single DC input power supply voltage to the gate voltage generator in response to the gray voltage generator power supply voltage.

2. A liquid crystal display power supply according to claim 1 wherein the switch is a transistor having a controlling electrode and a pair of controlled electrodes, wherein the pair of controlled electrodes are connected between the single DC input power supply voltage and the gate voltage generator and wherein the controlled electrode is connected to the gray voltage generator power supply voltage.

3. A liquid crystal display power supply that generates digital circuit power supply voltages, gray voltages and gate ON and OFF voltages for a liquid crystal display, the power supply comprising:

at least one DC-to-DC converter that is responsive to a single DC input power supply voltage to generate at least one digital circuit power supply voltage that supplies power to digital circuits of the liquid crystal display and to generate a gray voltage generator power supply voltage;

a gray voltage generator that is powered by the gray voltage generator power supply voltage to generate gray voltages for the liquid crystal display; and a gate voltage generator that is responsive to the gray voltage generator power supply voltage, to generate gate ON and OFF voltages for the liquid crystal display from the single DC input power supply voltage;

wherein the at least one DC-to-DC converter comprises a first DC-to-DC converter and a second DC-to-DC converter that is responsive to the first DC-to-DC converter;

wherein the first DC-to-DC converter is responsive to the single DC input power supply voltage to generate first and second digital circuit power supply voltages that supply power to digital circuits of the liquid crystal display; and wherein the second DC-to-DC converter is responsive to the second power supply voltage, to generate the gray voltage generator power supply voltage.

4. A liquid crystal display power supply that generates digital circuit power supply voltages, gray voltages and gate ON and OFF voltages for a liquid crystal display, the power supply comprising:

at least one DC-to-DC converter that is responsive to a single DC input power supply voltage to generate at least one digital circuit power supply voltage that supplies power to digital circuits of the liquid crystal display and to generate a gray voltage generator power supply voltage;

a gray voltage generator that is powered by the gray voltage generator power supply voltage to generate gray voltages for the liquid crystal display; and a gate voltage generator that is responsive to the gray voltage generator power supply voltage, to generate gate ON and OFF voltages for the liquid crystal display from the single DC input power supply voltage;

wherein the at least one DC-to-DC converter comprises a first DC-to-DC converter and a second DC-to-DC converter that is responsive to the first DC-to-DC converter;

wherein the second DC-to-DC converter is responsive to the first DC-to-DC converter, to generate the gray voltage generator power supply voltage after generation of the at least one digital circuit power supply voltage; and wherein the gate voltage generator is responsive to the gray voltage generator power supply voltage, to generate the gate ON and OFF voltages for the liquid crystal display from the single DC input power supply voltage after generation of the gray voltage generator power supply voltage.

5. A liquid crystal display comprising:

a liquid crystal display panel that displays images, the liquid crystal display panel including a plurality of gate lines and data lines;

a gate driver that drives the gate lines;

a data driver that drives the data lines;

a timing converter that is connected to the gate driver and the data driver to control timing of the gate driver and the data driver; and a power supply control circuit that is responsive to a single DC input power supply voltage, to generate power supply voltages for the gate driver, the data driver and the timing converter from the single DC input power supply voltage, wherein the power supply control circuit comprises:

a first DC-to-DC converter that is responsive to the single DC input power supply voltage to generate at least one power supply voltage that supplies power to the gate driver, the data driver and the timing converter;

a gray voltage generator that is responsive to a gray voltage generator power supply voltage to generate gray voltages for the data driver;

a second DC-to-DC converter that is responsive to the first DC-to-DC converter, to generate the gray voltage generator power supply voltage; and a gate voltage generator that is responsive to the gray voltage generator power supply voltage, to generate gate ON and OFF voltages for the gate driver from the single DC input power supply voltage.

6. A liquid crystal display comprising:

a liquid crystal display panel that displays images, the liquid crystal display panel including a plurality of gate lines and data lines;

a gate driver that drives the gate lines;

a data driver that drives the data lines;

a timing converter that is connected to the gate driver and the data driver to control timing of the gate driver and the data driver;

a power supply control circuit that is responsive to a single DC input power supply voltage, to generate power supply voltages for the gate driver, the data driver and the timing converter from the single DC input power supply voltage; and a switch that is connected between the single DC input power supply voltage, the gate voltage generator and the gray voltage generator power supply voltage, to supply the single DC input power supply voltage to the gate voltage generator in response to the gray voltage generator power supply voltage.

7. A liquid crystal display according to claim 6 wherein the data driver drives the data lines with a gray voltage and is powered by a data driver power supply voltage, and wherein the power supply control circuit generates the gray voltage and the data driver power supply voltage from the single DC input supply voltage.

8. A liquid crystal display according to claim 6 wherein the gate driver drives the gate lines with gate ON and OFF voltages and is powered by a gate driver power supply voltage, and wherein the power supply control circuit generates the gate ON and OFF voltages and the gate driver power supply voltage from the single DC input supply voltage.

9. A liquid crystal display comprising:

a liquid crystal display panel that displays images, the liquid crystal display panel including a plurality of gate lines and data lines;

a data driver that drives the data lines with a gray voltage and is powered by a data driver power supply voltage;

a gate driver that drives the gate lines with gate ON and OFF voltages and is powered by a gate driver power supply voltage;

a power supply control circuit that generates the data driver power supply voltage and the gate driver power supply voltage prior to generating the gray voltage and the gate ON and OFF voltages;

a timing converter that is connected to the gate driver and the data driver to control timing of the gate driver and the data driver and that is powered by a timing converter power supply voltage, and wherein the power supply control circuit also generates the timing converter power supply voltage prior to generating the gray voltage and the gate ON and OFF voltages;

wherein the power supply control circuit comprises:

a first DC-to-DC converter that is responsive to a single DC input power supply voltage to generate at least one power supply voltage that supplies power to the gate driver, the data driver and the timing converter;

a gray voltage generator that is responsive to a gray voltage generator power supply voltage to generate gray voltages for the data driver;

a second DC-to-DC converter that is responsive to the first DC-to-DC converter, to generate the gray voltage generator power supply voltage; and a gate voltage generator that is responsive to the gray voltage generator power supply voltage, to generate gate ON and OFF voltages for the gate driver from the single DC input power supply voltage.

10. A liquid crystal display comprising:

a liquid crystal display panel that displays images, the liquid crystal display panel including a plurality of gate lines and data lines;

a data driver that drives the data lines with a gray voltage and is powered by a data driver power supply voltage;

a gate driver that drives the gate lines with gate ON and OFF voltages and is powered by a gate driver power supply voltage;

a power supply control circuit that generates the data driver power supply voltage and the gate driver power supply voltage prior to generating the gray voltage and the gate ON and OFF voltages;

a timing converter that is connected to the gate driver and the data driver to control timing of the gate driver and the data driver and that is powered by a timing converter power supply voltage, and wherein the power supply control circuit also generates the timing converter power supply voltage prior to generating the gray voltage and the gate ON and OFF voltages; and a switch that is connected between the single DC input power supply voltage, the gate voltage generator and the gray voltage generator power supply voltage, to supply the single DC input power supply voltage to the gate voltage generator in response to the gray voltage generator power supply voltage.

11. A liquid crystal display power supply that generates digital circuit power supply voltages, gray voltages and gate ON and OFF voltages for a liquid crystal display, the power supply comprising:

first means for generating at least one digital circuit power supply voltage that supplies power to digital circuits of the liquid crystal display and for generating a gray voltage generator power supply voltage, in response to a single DC input supply voltage;

second means for generating gray voltages for the liquid crystal display in response to the gray voltage generator power supply voltage;

third means for generating gate ON and OFF voltages for the liquid crystal display from the single DC input power supply voltage, in response to the second means; and means for supplying the single DC input power supply voltage to the third means in response to the gray voltage generator power supply voltage.

12. A liquid crystal display power supply according to claim 11 wherein the third means is responsive to the second means, for generating the gate ON and OFF voltages for the liquid crystal display from the single DC input power supply voltage after generation of the gray voltage generator power supply voltage.

* * * * *